United States Patent [19]

Ohtake et al.

[11] Patent Number: 4,482,334

[45] Date of Patent: Nov. 13, 1984

[54] METHOD FOR MAKING CRT SHADOW MASKS

[75] Inventors: Yasuhisa Ohtake; Kazuyuki Seino; Eiji Kamohara, all of Fukaya, Japan

[73] Assignee: Tokyo Shibaura Denki Kabushiki Kaisha, Kanagawa, Japan

[21] Appl. No.: 409,354

[22] Filed: Aug. 19, 1982

[30] Foreign Application Priority Data

Sep. 10, 1981 [JP] Japan ..... 56-141740

[51] Int. Cl.[3] ..... H01J 29/07

[52] U.S. Cl. ..... 445/47; 445/37; 72/363

[58] Field of Search ..... 445/37, 47; 269/8; 72/363; 29/423, 424, 445; 313/402, 407

[56] References Cited

U.S. PATENT DOCUMENTS

| | | | |
|---|---|---|---|
| 2,971,117 | 2/1961 | Law | 315/13.1 |
| 3,046,202 | 7/1962 | Horner | 204/11 |
| 3,176,387 | 4/1965 | Argueso, Jr. et al. | 29/423 |
| 3,398,309 | 8/1968 | Kaplan | 313/402 |
| 3,566,661 | 3/1971 | McCafferty et al. | 29/423 |
| 3,574,013 | 4/1971 | Frantzen | 313/402 |
| 3,623,197 | 11/1971 | Jones | 445/37 |
| 3,688,359 | 9/1972 | Oikawa | 445/47 |
| 3,800,398 | 4/1974 | Harrington, Jr. | 29/423 |
| 3,909,656 | 9/1975 | Stachniak | 313/402 |
| 3,914,969 | 10/1975 | Banks | 72/363 |
| 3,922,395 | 11/1975 | Smith | 427/247 |
| 4,112,563 | 9/1978 | Van Esdonk | 445/37 |
| 4,392,914 | 7/1983 | Takenaka et al. | 313/402 |

FOREIGN PATENT DOCUMENTS

| | | | |
|---|---|---|---|
| 0097361 | 8/1979 | Japan | 445/47 |

*Primary Examiner*—Kenneth J. Ramsey
*Assistant Examiner*—Kurt Rowan
*Attorney, Agent, or Firm*—Cushman, Darby & Cushman

[57] ABSTRACT

A method of making a mask arrangement including two (2) or more of masks for a mask-focusing color picture tube and the mask arrangement formed by the method. A plurality of apertured flat masks, each mask comprising an effective portion having apertures and a non-effective portion surrounding the effective portion, are prepared. The flat masks are aligned and stacked, then filling material is poured into the apertures. The filling material is solidified thereby fixing the flat masks together. The fixed masks are pressed into a predetermined curved shape. Then, the filling material is removed from the apertures and the masks are separated.

10 Claims, 7 Drawing Figures

METHOD FOR MAKING CRT SHADOW MASKS

BACKGROUND OF THE INVENTION

The present invention provides a method of making a mask arrangement including two (2) or more masks for a color cathode ray tube (CRT). Typically the masks are positioned at a small distance from the CRT's phosphor screen and are separated from each other, each aperture of each mask being arranged coaxially with a corresponding aperture of another mask over the entire effective area of all masks.

One such CRT having this type of mask structure is the mask-focusing color picture tube. In a mask-focusing color picture tube, different potentials are applied to the masks and an electrostatic lens is formed by the biased masks. The electron beam utility factor of the CRT is significantly increased compared with a convential shadow mask type color CRT. A mask-focusing color picture tube is described in Japanese Utility Model publication No. 38930/1972, and U.S. Pat. Nos. 2,971,117 and 3,398,309.

Another type of CRT which has the above described mask structure is described in Japanese Patent Publication No. 2698/1980. In that particular color CRT the mask arrangement includes two (2) masks. One mask acts as a color selection electrode and the other mask acts as a electron shield for preventing the other mask from being bombarded by electronic beams and from being deformed by a rise in temperature resulting from that bombardment.

In the both types of color CRTs, the corresponding apertures of the masks must be aligned coaxially with the electron beams. However, it is difficult to make or assemble a plurality of masks with the desired high precision of coaxial alignment. In a conventional manner, each apertured flat mask is pressed into its desired curved shape independently from the other mask(s). The masks are made of thin metal plates and have relatively large areas so that they are subject to being deformed during handling in the manufacturing process. The curvature of each mask is inevitably slightly different from that of the other masks at a given position on the masks. Therefore, it is difficult to precisely align the corresponding apertures of each mask.

SUMMARY OF THE INVENTION

A primary object of the present invention is to provide a method of making a plurality of masks for a color CRT, which method facilitates the precise alignment desired for the corresponding apertures of each mask.

Another object of the present invention is to provide a method suitable for the mass production of precisely aligned CRT masks.

Therefore the present invention provides a method of making a mask arrangement including at least two (2) masks for a CRT including the steps of: preparing a plurality of flat masks, each mask having an effective portion having a plurality of apertures therein and a non-effective portion surrounding the effective portion; stacking the flat masks so as to align corresponding apertures of the masks; filling the apertures of the flat masks with filling material; solidifying the filling material thereby fixing the flat masks together; simultaneously pressing the fixed flat masks in a predetermined curvature; and removing the filling material from the masks.

The present invention also provides a mask arrangement formed by the above described manufacturing steps.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
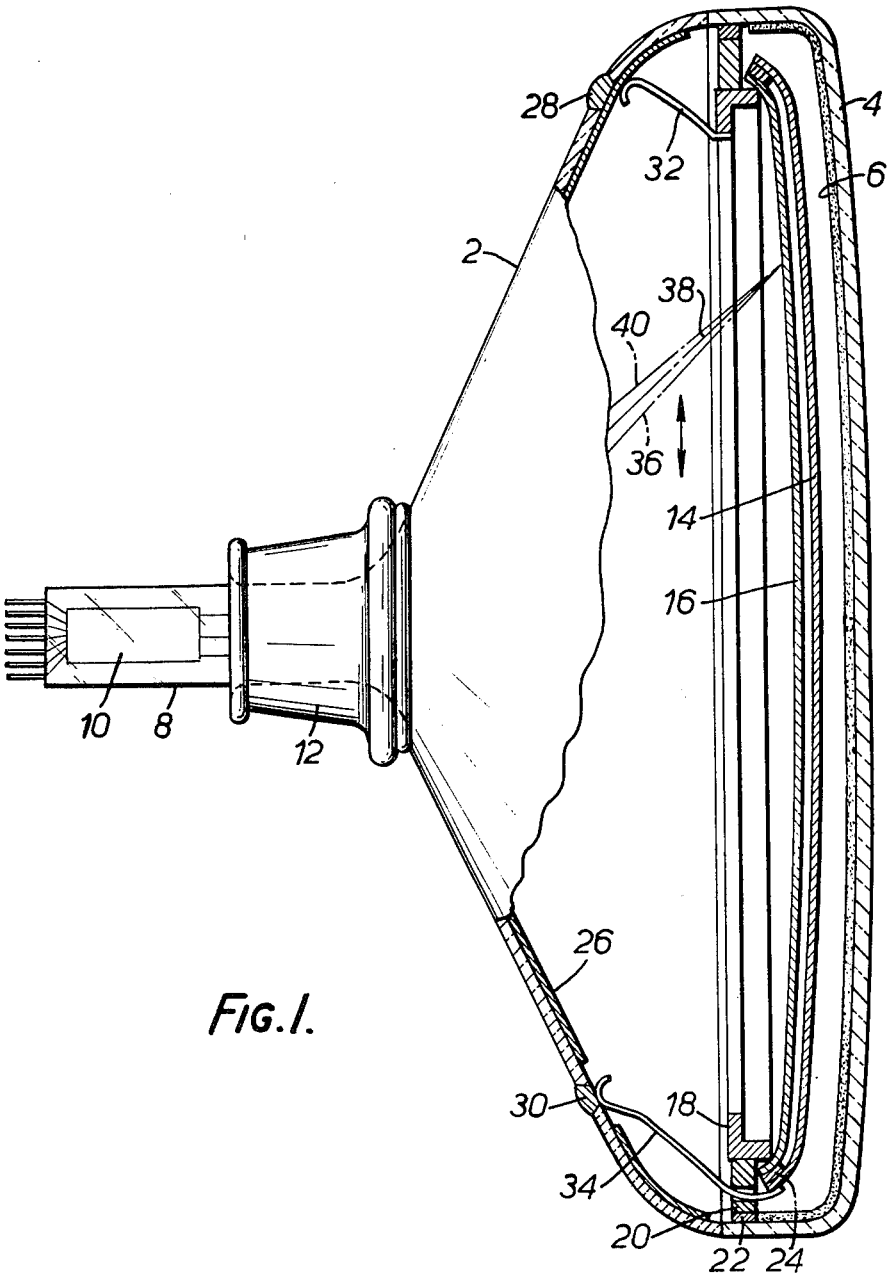
FIG. 1 is a cross-sectional view of a mask-focusing color cathode ray tube.

Referring now to FIG. 1, there is shown a cross-sectional view showing the arrangement of a mask-focusing color picture tube including a mask arrangement having two (2) of masks formed according to to the present invention. A funnel 2 is joined to the outer periphery of a face plate 4, on the inner surface of which is formed a metal-backed phosphor screen 6. A neck 8 is joined to the end of funnel 2. Electron guns 10 are disposed within neck 8. A deflection apparatus 12 is mounted on the outer surfaces of funnel 2 and around neck 8. A first shadow mask 14 opposes phosphor screen 6, and a second shadow mask 16 opposes first shadow mask 14. First and second masks 14 and 16 each have a plurality of apertures therein shadow mask 16 is mounted to face place 4 by a mask frame 18, eleastic support members 20 and pins 22. First shadow mask 14 is mounted to second shadow mask 16 through an insulating member 24.

The metal-backed phosphor screen 6 comprises phosphor stripes of regularly alternating three colors coated on the inner surface of face plate 4, and a thin metal layer formed on the phosphor stripes. A conductive film 26 is uniformly coated on the inner surface of funnel 2 and on part of the inner surface of neck 8. Two buttons 28 and 30 are mounted on funnel 2 for applying the different voltages from outside. Button 28 is electrically connected to conductive film 26 and to a resilient conductive connector 32 connecting to mask frame 18 and the metal-backed phospher screen layer 6 through pins 22. Button 30 is electrically connected to first shadow mask 14 through a resilient conductive connector 34. The applied potential of metal-backed phosphor screen 6 and second mask 16 is slighly higher than the potential applied to first shadow mask 14.

In the color picture tube arrange describe above, three electron beams 36, 38 and 40 emitted from the electron guns 10 deflected by deflection apparatus 12, are selectively focused by second and first shadow masks 16 and 14, the beams passing through their respective apertures and impinging on the appropriate phosphor stripes of screen 6 which then emit light of the corresponding colors. Therefore the corresponding apertures of each mask must be arranged coaxially. The method steps according to the present invention for fabricating the masks and forming the resulting product will be describe below.

Figure 2:
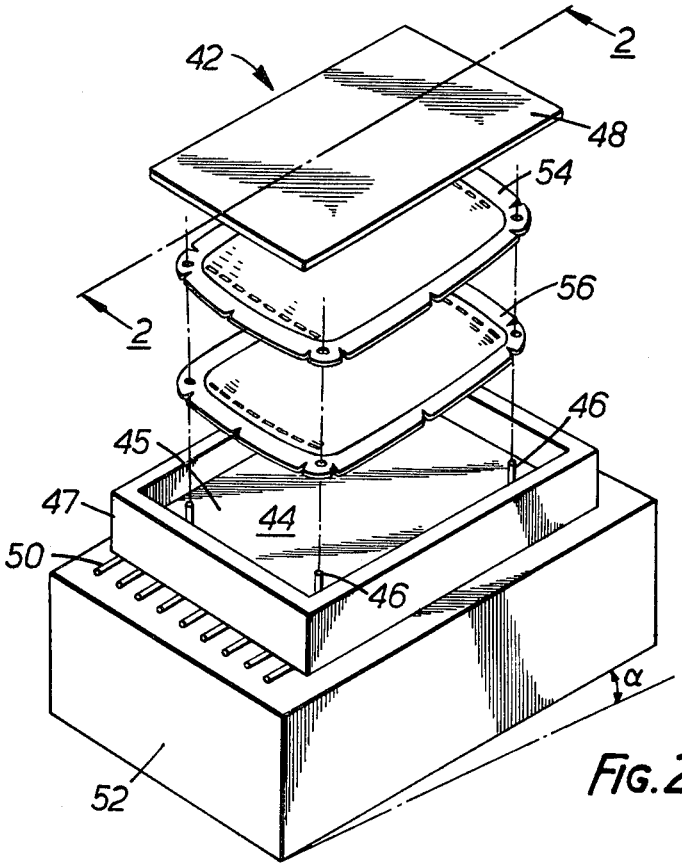
FIG. 2 is a perspective view illustrating one step of the fabrication method of the present invention.

Referring now to FIG. 2, there is shown a perspective view illustrating the apparatus used in the fabrication technique and showing the flat masks employed in making the mask arrangement. Reference numeral 42 denotes the apparatus including: a surface plate 44 having a flat surface 45 and location registration pins 46, walls 47 provided at the periphery of flat surface 45, an upper plate 48, heaters 50 provided under surface plate 44 and an electro magnet 52 provided under the heaters. An alignment of the apertures of two flat masks 54 and 56 is performed by this apparatus 42. Flat masks 54 and 56 are placed on surface plate 44 with reference to location regulating pins 46.

Figure 3:
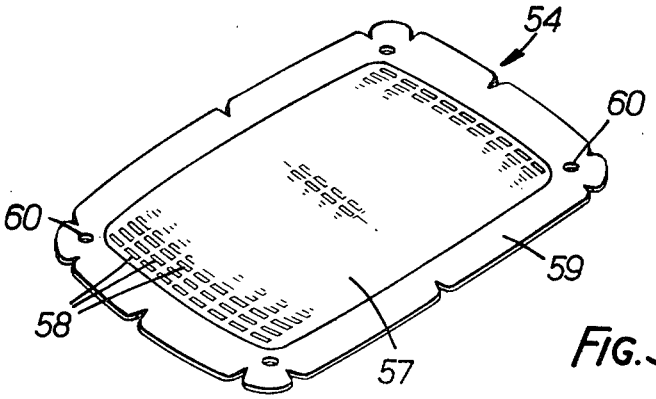
FIG. 3 is a perspective view showing a apertured flat mask.

Referring now to FIG. 3, there is shown a perspective view of flat mask 54. Flat mask 56 is identical to flat mask 54 and is therefore not shown. Flat mask 54 includes an effective portion 57 having a plurality of dots or slit apertures 58 and non-effective portion 59 surrounding the effective portion. Guide holes 60 facilitate positioning of the flat mask and are provided at the four corners of the non-effective portion. Guide holes 60 are adapted to location registration pins 46 shown in FIG. 2. When pins 46 engage guide holes 46 of each mask, the corresponding apertures of each mask are aligned with high precision.

Figure 4:
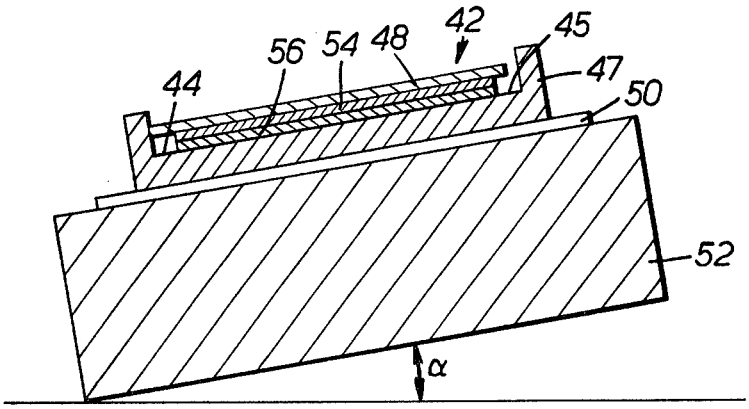
FIG. 4 is a cross-section taken along 2—2 of FIG. 2 of the apparatus.

Referring again to FIG. 2, after placing apertured flat masks 54 and 56 and upper plate 48 on surface plate 44, electro magnet 52 for generating electro-magnetic force is operated and stacked flat masks 54 and 56 and upper plate 48 are pressed together over their entire areas and are forced into contact each other as shown in FIG. 4. Heater 50 then operated so as to elevate the temperature of surface plate 44, apertured flat masks 54 and 56 and upper plate 48. A heat dissolvable paraffin is poured onto surface plate 44 from the uppermost side of apparatus 42. The paraffin penetrates into the apertures of flat masks 54 and 56 until the apertures become filled with paraffin. This filling step is performed while apparatus 42 is inclined as shown in FIG. 4. After the paraffin has penetrated into the apertures adequately, heaters 50 are turned off and flat masks 54 and 56 and the paraffin are cooled. The paraffin becomes solidified and flat masks 54 and 57 are firmly fixed together by the solidified paraffin. Electro magnet 52 is then deactivated so as to remove the magnetic force and flat masks 54 and 56, fixed together with paraffin, are removed from apparatus 42.

Figure 5:
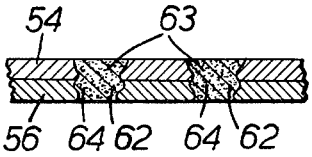
FIG. 5 is a cross-sectional enlarged view of fixed flat masks showing one step of the invention.

FIG. 5 shows a enlarged cross-sectional view of the flat masks showing apertures filled with paraffin 62. Even though apertures 63 are aligned, their respective shapes are not identical. Therefore, the parafin tends to bind the two masks when it falls in the irregularities. Note the complex configuration of apertures 63 and 64 in masks 54 and 56 respectively.

Figure 6:
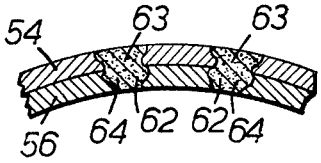
FIG. 6 is a cross-sectional enlarged view of curved masks showing another step of the invention.

Referring now to FIG. 6, after flat masks 54 and 56 are fixed with parafin, they are simulataneously pressed to a predetermined shape, in a manner known in the prior art for pressing a shadow mask of conventional cathode ray tube. During the pressing step, the solidfied paraffin filled in the apertures will incline along the curvature of the mask so that the sliding and uniform stretching of the masks is prevented.

Figure 7:
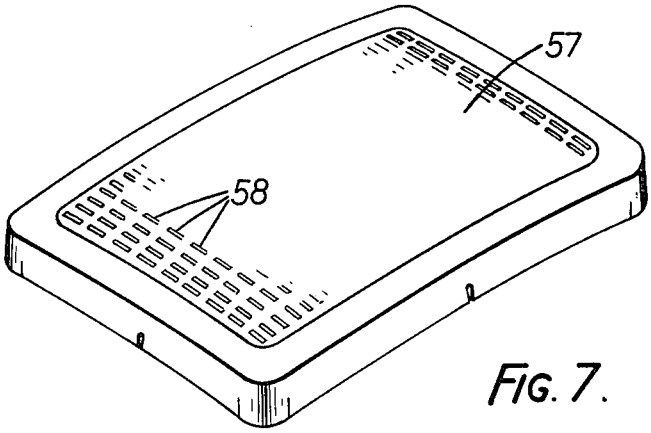
FIG. 7 is a perspective view of masks showing one step of the invention.

Referring now to FIG. 7 there is shown a perspective view of the mask arrangement after pressing.

After pressing the masks, the paraffin is removed from the masks and the curved masks are separated. The separated masks are held fixedly by a mask frame so as to be separated from each other with predetermined gap as shown in FIG. 1. The step of removing paraffin is carried out as follows. The pressed masks 54 and 56 are washed with hot water, and paraffin is washed away. Then pressed masks 54 and 56 are treated by trichloroethylen to dissolve any remaining paraffin adhereing to the masks. In the step of washing with hot water, the washed away paraffin can be recovered easily for reuse. Thus, this method is economical.

The two masks framed by the above-mentioned manner can be constructed into a mask arrangement without any distortion of apertures and any offset of the corresponding apertures and any offset of the corresponding apertures of each mask. Further according to the present invention, it is not necessay to weld the two flat masks for fixing and it is also not necessary to cut off the welding portion, so that there is no problem to deform the pressed masks in the step of separating the masks.

In the above-described embodiment, paraffin is used as filling material, however, other materials can be used as parafin substitutes as long as they meet the following criteria. First, the material must be a liquid or have a desired viscosity when it is poured and must be capable of being solidified in some manner after being poured. Second, it must be dissolvable or decomposable in some manner. For example, phenol resin, polyvinyl resin, gelatin and varnish are preferably used as the filling material. In the described embodiment paraffin is employed because of its cheap price and its ease of handling. The parafin used in the non-liminative presently preferred exemplary embodiment has a melting point of 62° to 64° C., however, the melting point is not serious matter if the above mentioned factors are satisfied. However, a melting point of more than 50° C. is preferable because the press-forming is best carried out at room temperature. Further it should be understood that ethyl, hot-alcohol, or other chemical material and heat treatments are available for removing paraffin even though hot water and trichloroethylene were described as being preferred.

In the exemplary embodiment described, an electro magnet is used for forcing the flat masks into contact with one another. However, a weight having a flat surface can be substituted. Furthermore, it should be understood that he present invention can be applied to the manufacture of more than two masks even though a two masks embodiment was described.

According to the present invention, two apertured flat masks are stacked and the apertures are filled with filling material and two masks are firmly fixed together by solidified filling material. Then the two masks are simultaneously pressed into the desired shape. Thus, it is easy to align the corresponding apertures of each mask. And the sliding and nonuniform stretching of the masks are prevented. Further according to the present invention, the separating of the two masks can be performed by removing filling material. The filling material can be removed by heat or in a chemical manner without damage or deformation to the masks. Masks for a color CRT having a plurality of masks whose apertures of each mask must be arranged coaxially with high precision can be made easily by this method.

While the invention has been described in connection with what is presently considered to be the most practical and preferred embodiments, it is to be understood that the invention is not to be limited to the disclosed embodiments but on the contrary, is intended to cover various modifications and equivalent arrangements included with the spirit and scope of the appended claims which scope is to be accorded the broadest interpretation so as to encompass all such modifications and equivalents structures.

What is claimed is:

1. A method of making a mask arrangement for a cathode ray tube (CRT) comprising the steps of:
   providing two (2) flat masks, each mask comprising an effective portion having a plurality of apertures therein and a non-effective portion surrounding said effective portion;
   stacking said flat masks;
   filling said apertures of said flat masks with filling material;
   solidifying said filling material thereby fixing said flat masks together;
   simultaneously pressing said fixed flat masks into a predetermined curvature; and
   removing said filling material from the masks.

2. A method of making a mask arrangement according to claim 1, wherein said filling step comprises the step of filling at least one material selected from the group consisting of: phenol resin, epoxy resin, polyvinyl resin, paraffin, gelatin and varnish.

3. A method of making a mask arrangement according to claim 2, wherein said filling step comprises the step of filling paraffin.

4. A method of making a mask arrangement according to claim 1, wherein said removing step comprises the step of removing said filling material by heat or chemical treatment.

5. A method of making a mask arrangement comprising the steps of:
   providing two (2) flat masks, each mask including an effective portion having a plurality of apertures and a noneffective portion surrounding said effective portion;
   stacking said flat masks;
   applying a magnetic force to said flat masks to hold them in contact with each other;
   filling said apertures of said flat masks with filing material;
   solidifying said filling material thereby fixing said flat masks together;
   releasing said fixed flat masks from said magnetic force;
   simultaneously pressing said fixed flat masks into the predetermined curvature; and
   removing said filling material from the masks.

6. A method of making a mask arrangement according to claim 5, wherein said step of applying a magnetic force comprises the step of applying an electro magnetic force.

7. A method of making a mask arrangement according to claim 5, wherein said stacking step comprises the step of stacking the flat masks on a surface plate having a flat surface.

8. A method of making a mask arrangement according to claim 5, wherein said filling step comprises the step of filling at least one material selected from phenol resin, epoxy resin, polyvinyl resin, paraffin, gelatin and varnish.

9. A method of making a mask arrangement according to claim 8, wherein said filling step comprises the step of filling paraffin.

10. A method of making a mask arrangement according to claim 5, wherein said removing step comprises the step of removing said filling material by heat or chemical treatment.

* * * * *